United States Patent [19]

Mizuno et al.

[11] 4,404,877

[45] Sep. 20, 1983

[54] POWER-DRIVEN SCREWDRIVER

[75] Inventors: Megumi Mizuno; Shigeru Ishikawa; Eiki Kubo, all of Tokyo, Japan

[73] Assignees: Sanyo Industries, Ltd.; Muro Kinzoku Kogyo Co., Ltd., both of Tokyo, Japan

[21] Appl. No.: 309,975

[22] Filed: Oct. 9, 1981

[51] Int. Cl.[3] ..... B25B 23/04

[52] U.S. Cl. ..... 81/57.37; 81/435; 227/136

[58] Field of Search ..... 81/57.37, 435, 437; 221/197; 227/135, 136; 144/32 S

[56] References Cited

U.S. PATENT DOCUMENTS 3,910,324 10/1975 Nasiatka ..... 227/136 X 4,146,071 3/1979 Mueller et al. ..... 227/136 X

*Primary Examiner*—Robert C. Watson

*Assistant Examiner*—Debra S. Meislin

*Attorney, Agent, or Firm*—Robert E. Burns; Emmanuel J. Lobato; Bruce L. Adams

[57] ABSTRACT

A power-driven screwdriver for use with a motor-driven tool for driving a strip of screws one at a time into a workpiece and having an outer guide frame in which a slide block and a slide plate are slidably mounted. A screw indexing lever is angularly movably mounted on the slide block and has a pin received in a first cam slot having an oblique portion and defined in the outer guide frame and a second cam slot defined in the slide plate. When the motor-driven tool is pushed toward a workpiece, the slide block and the slide plate are slid into the outer guide frame, allowing a screwdriver bit to engage and drive a screw into the workpiece. After the screw has been driven, the motor-driven tool is retracted away from the workpiece, whereupon the slide block and the slide plate are forced to slide out of the outer guide frame under the bias of a spring around the screwdriver bit. As the pin on the screw indexing lever enters the oblique portion of the first cam, the screw indexing lever is caused to turn feeding a next screw to a position aligned with the screwdriver bit.

7 Claims, 9 Drawing Figures

POWER-DRIVEN SCREWDRIVER

BACKGROUND OF THE INVENTION

1. Field of the Invention

The present invention relates to a power-driven screwdriver for successively driving screws into a workpiece.

2. Prior Art

A known screw tightening apparatus as disclosed in Japanese Laid-Open Patent Publication No. 53-37968, published Apr. 7, 1978, includes a screw indexing lever movable to advance a strip of screws when a fork-shaped protective plate or a leg plate is forcibly pressed against a workpiece. The strip of screws is subjected to undue tensile forces which tend to skew a screw in a position to be driven. The prior apparatus also has a slide block and a slide plate which are normally urged by a spring toward a position in which the free end of a screwdriver bit is disposed in the slide block, and the spring is displaced off the axis of the screwdriver bit. When the slide block and the slide plate are forced to slide into an outer frame against the resiliency of the spring before a screw is driven by the screwdriver bit, the slide block and the slide plate are liable to become inclined with respect to the screwdriver bit, a disadvantage which renders the screwdriver apparatus difficult to handle. The screw indexing lever is also spring-loaded to feed screws, and the operator finds the known screw tightening apparatus quite heavy and sluggish during screw driving operation. The conventional power-driven screwdriver is also disadvantageous in that it can easily damage the workpiece, the worn screwdriver bit cannot readily be replaced with a new one, and the screw being driven is likely to get tilted at it passes through the fork-shaped protective plate.

SUMMARY OF THE INVENTION

It is an object of the present invention to provide a power-driven screwdriver which can drive screws successively into a workpiece properly and reliably.

Another object of the present invention is to provide a screw indexing mechanism for feeding a succession of screws reliably into a power-driven screwdriver without screws' being skewed or inclined.

Still another object of the present invention is to provie a power-driven screwdriver having moving parts biased by a spring disposed around a screwdriver bit and slidable smoothly, with a remoter possibility for a spring-loaded protective plate to damage a workpiece.

Still another object of the present invention is to provide a power-driven screwdriver which is simple in construction, lightweight, and can be disassembled and adjusted with ease.

Still another object of the present invention is to provide a power-driven screwdriver so structured that it will permit easy replacement of a worn screwdriver bit, prevent screws while being driven from getting tilted, and provide easy adjustment of the degree to which the screw is to be driven into a workpiece.

According to the present invention, an elongate outer guide frame of a power-driven screwdriver has a longitudinal cam slot including an oblique portion and extending substantially parallel to a screwdriver bit extending through a slide block slidably mounted in the outer guide frame, the screwdriver bit being attachable to a motor-driven tool. A slide plate slidably supported on the slide block has a transverse cam slot extending substantially perpendicularly to the screwdriver bit. A screw indexing lever is swingably mounted on the slide block and has on one end thereof a pin received in the longitudinal and transverse cam slots. When the motor-driven tool is pushed toward a workpiece, the slide block and the slide plate are caused to slide into the outer guide frame against the bias of a spring around the screwdriver bit as the pin moves along the longitudinal cam slot. After the screwdriver bit has driven a screw into the workpiece and when the motor-driven tool is retracted away from the workpiece, the slide block and the slide plate are forced to slide out of the outer guide frame under the resiliency of the spring. When the pin enters the oblique portion of the longitudinal cam slot and the transverse cam slot, the screw indexing lever is turned to supply a next screw to a position in front of the screwdriver bit. The outer guide frame has a slant slot in which there is fastenably disposed a stop pin with which the slide block is engageable at a rear end thereof to adjust the extent to which the slide block is insertable into the outer guide frame and hence the extent to which the screw can be driven into the workpiece. The slide block has a hook-shaped slot near the rear end receptive of the stop pin. When the stop pin is received and retained in the hook-shaped slot, the slide block remains fully inserted in the outer guide block, allowing the screwdriver bit to be exposed and replaced easily with a new one.

The above and other objects, features and advantages of the present invention will become apparent from the following description when taken in conjunction with the accompanying drawings which show a preferred embodiment of the present invention by way of illustrative example.

DETAILED DESCRIPTION OF THE PREFERRED EMBODIMENT

Figure 1:
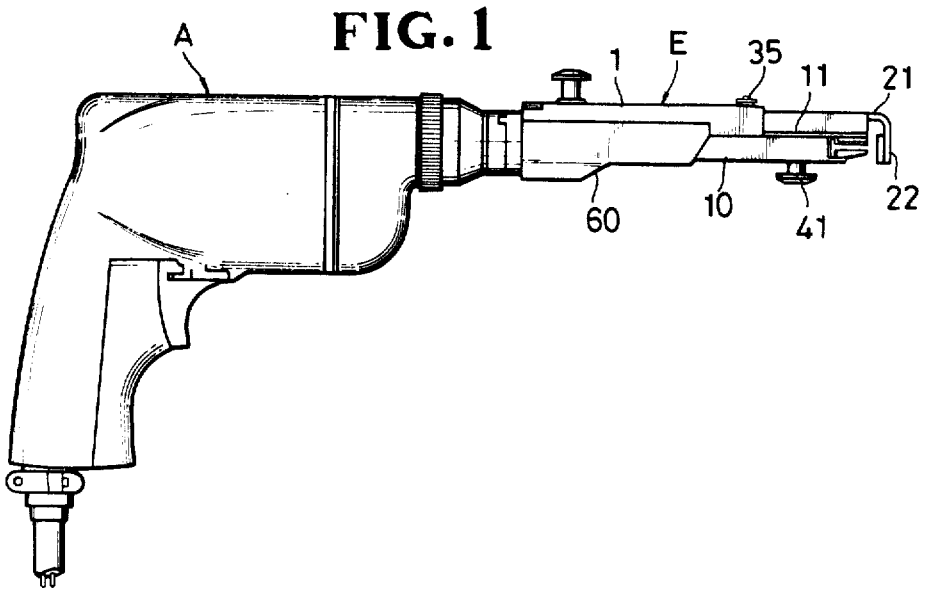
FIG. 1 is a side elevational view of a power-driven screwdriver according to the present invention, as attached to a motor-driven tool.

As shown in FIG. 1, a power-driven screwdriver E is attached to a portable motor-driven tool A such for example as an electric drill for being driven thereby. The motor-driven tool A is of any conventional structure and may be energized by any suitable source of power though electric operation is preferable because of no need for compressed air or other mediums.

Figure 2:
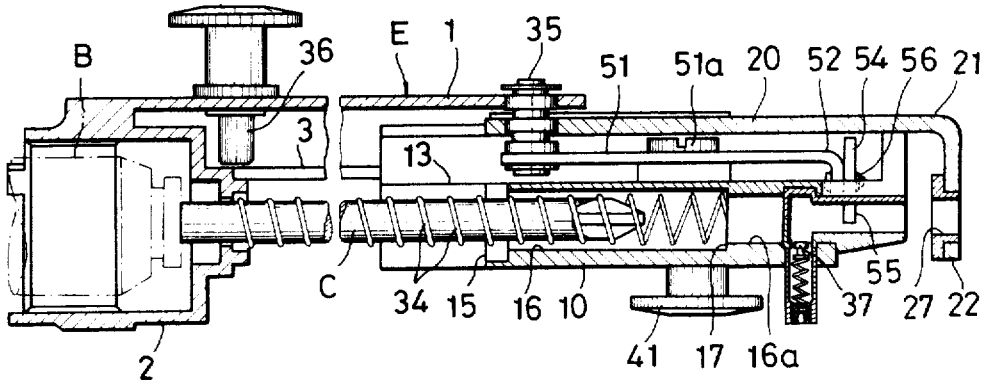
FIG. 2 is a longitudinal cross-sectional view of the power-driven screwdriver shown in FIG. 1.

In FIG. 2, the motor-driven tool A has a rotatable member or chuck B for holding a screwdriver bit C. The power-driven screwdriver E generally comprises an outer guide frame 1 having a substantially channel-shaped cross section (FIG. 6), a slide block 10 slidably mounted in the outer guide frame 1, and a slide plate 20 slidably supported on the slide block 10, the slide plate 20 being disposed between the outer guide frame 1 and the slide block 10. The slide block 10 and the slide plate 20 are telescopically movable in the same direction with respect to the outer guide frame 1. A cover 60 (FIGS. 1 and 6) is resiliently snapped on the outer guide frame 1 to close the open side of the latter.

Figure 5:
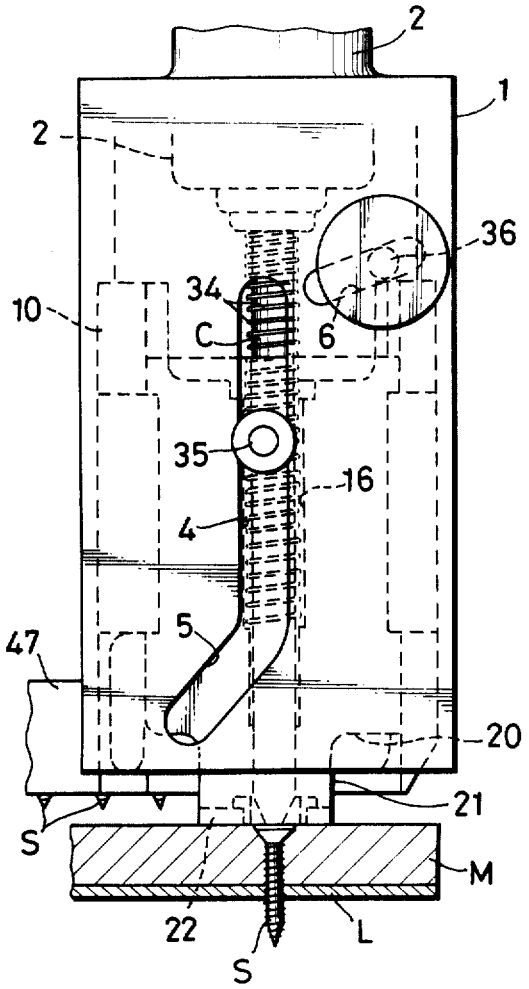
FIG. 5 is a plan view of the screwdriver, showing the parts positioned just after a screw has been driven in a workpiece.
Figure 6:
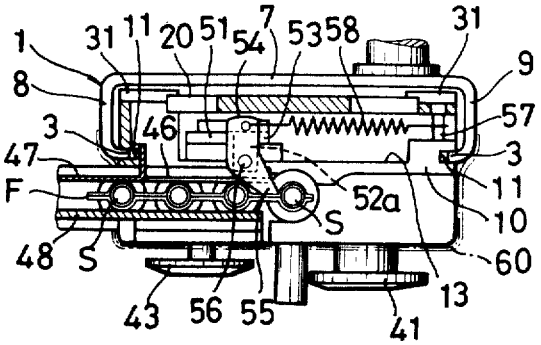
FIG. 6 is a front elevational view, partly in cross section, of the screwdriver.

As best illustrated in FIG. 5, the outer guide frame 1 is of an elongate shape and has an elongate dimension such that it will accommodate the slide block 10 therein. The outer guide frame 1 includes, as shown in FIG. 6, a bottom 7 and a pair of spaced sidewalls 8, 9 projecting laterally from the bottom 7 and having a pair of ridges 3, 3, respectively, directed toward each other. The outer guide frame 1 also has on an end thereof an attachment sleeve 2 for being mounted on the motor-driven tool A, the chuck B being positioned in the attachment sleeve 2. The block 10 is slidable into and out of the outer guide frame 1 through an open end of the latter which is located remotely from the attachment sleeve 2.

The slide block 10 is also elongate in shape and has a length which is about four-fifths of the length of the outer guide frame 1, and a maximum thickness which is about two times the depth of the outer guide frame 1. The slide block 10 has a pair of grooves 11, 11 (FIGS. 6 and 7) defined respectively in opposite side faces thereof and opening away from each other. The ridges 3, 3 of the outer guide frame 1 are slidably received in the grooves 11, 11, respectively. Thus, the slide block 10 is guided by the ridges 3, 3 to slide into and out of the outer guide frame 1.

Figure 7:
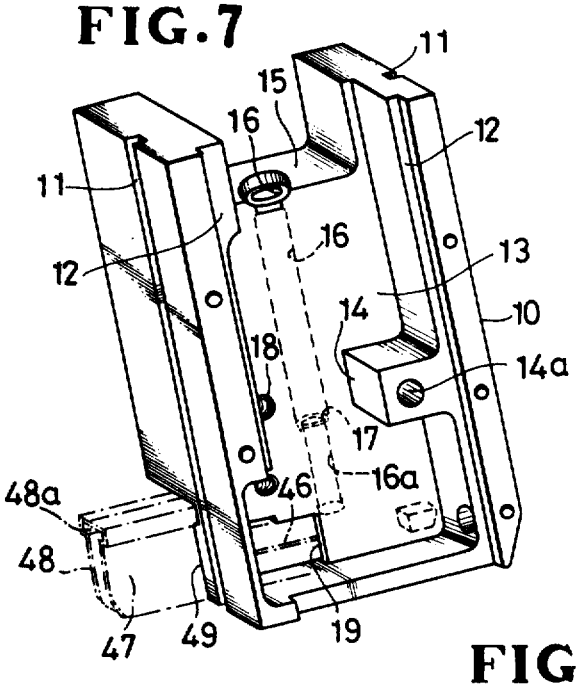
FIG. 7 is a perspective view of a slide block for receiving therein a screw bit and a screw indexing mechanism.
Figure 8:
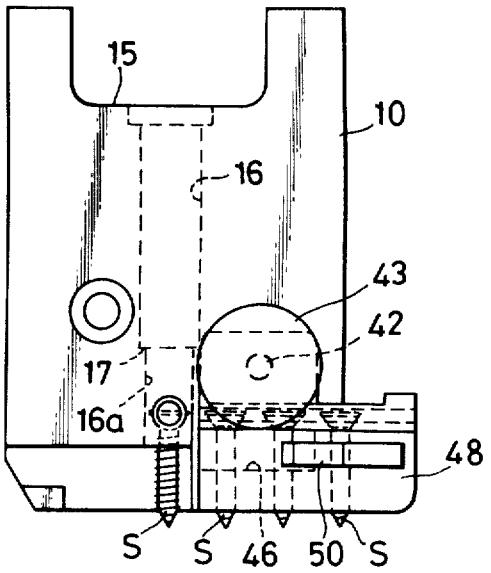
FIG. 8 is a rear view of the slide block illustrated in FIG. 7.

The guide plate 20 also has an elongate configuration having a length which is about four-fifths of that of the slide block 10 and a width which is about two-thirds of that of the slide block 10. A nose 21 extends from the guide plate 20 and has a flat bent portion 22 perpendicular to the guide plate 20 and disposed in overhanging relation to a distal end of the slide block 10, the nose 21 having a width which is approximately half the width of the slide plate 20. The slide plate 20 rides slidably on a pair of shoulders 12, 12 (FIG. 7) on the slide block 10 and is retained thereon against dislodgement by a pair of holder strips 31, 31 screwed to the slide block 10 and overhanging the shoulders 12, 12, respectively, as shown in FIG. 7. The flat bent portion 22 serves as a protective plate for protecting a workpiece while a screw is driven thereinto by the screwdriver E and as a guide surface for assisting in assuring perpendicularity of the screw while the latter is being driven.

The slide plate 20 has a longitudinal slot 23 in which there is disposed a spring adjustment member 32 fixed to the slide block 10. A compression coil spring 33 is also disposed in the slot 23 and acts between the slide plate 20 and the spring adjustment member 32 to normally bias the slide plate 20 in a direction to move the latter out of the slide block 10.

The slide block 10 is illustrated in its entirely in FIG. 7, and has a recess 13 extending laterally between the shoulders 12, 12 and having a depth which is substantially half the maximum thickness of the slide block 10. The slide block 10 includes a projection 14 having an upper surface extending continuously from and lying substantially flush with one of the shoulders 12. The projection 14 has a hole 14*a* through which extends a screw 41 (FIGS. 1, 2 and 6) which extends through an oblong hole 14*c* in the spring adjustment member 32 and threadedly into an internally threaded retainer 14*b*. By loosening the screw 41, the spring adjustment member 32 can be moved relatively to the slide block 10, thus permitting adjustment of the resiliency of the spring 33. The slide block 10 also has a cavity 15 receptive therein of the attachment sleeve 2 of the outer guide frame 1, and a longitudinal through bore 16 communicating with the cavity 15 and receiving therein part of the screwdriver bit C as best shown in FIG. 2. The bore 16 includes a small-diameter portion 16*a* extending from an annular step 17 and having a diameter large enough to allow passage therethrough of the screwdriver bit C with a slight clearance. A compression coil spring 34 is disposed around the screwdriver bit C and acts between the attachment sleeve 2 of the outer guide frame 1 and the step 17 in the bore 16 to normally bias the slide block 10 in a direction to slide out of the outer guide frame 1, as illustrated in FIG. 3.

Figure 3:
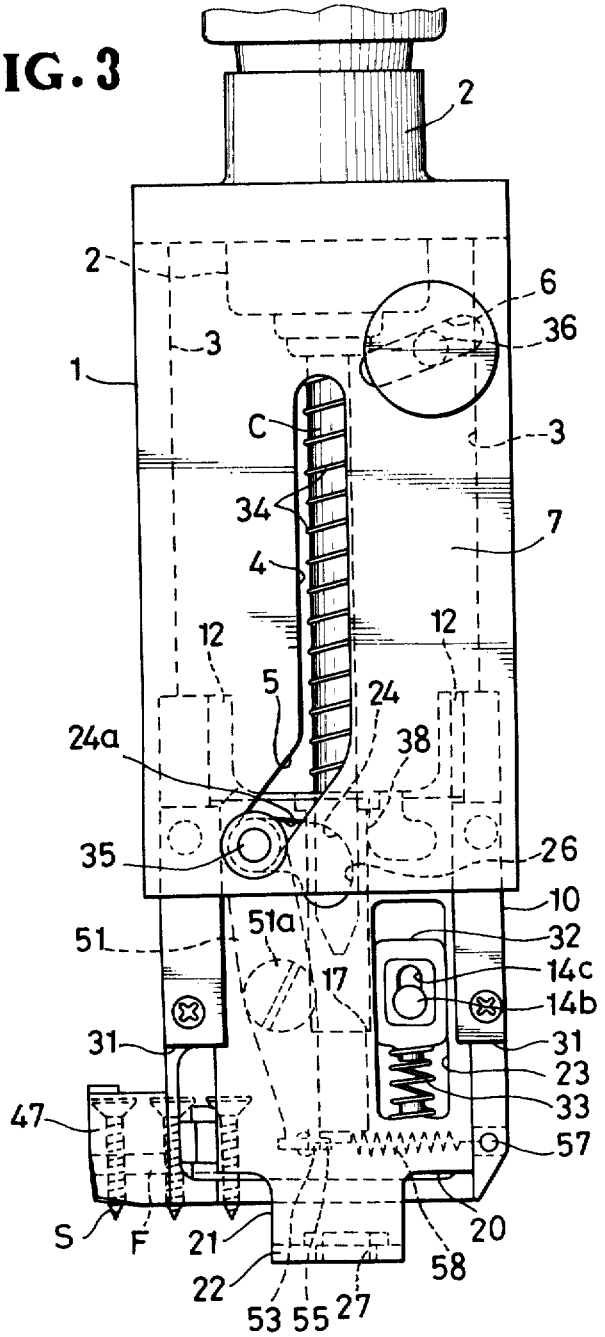
FIG. 3 is a plan view of the power-driven screwdriver.
Figure 4:
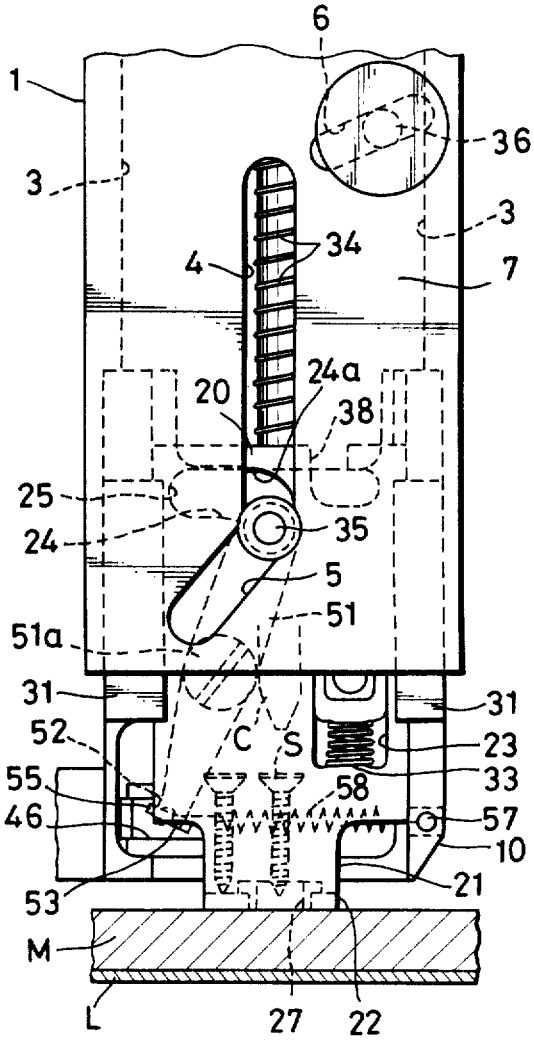
FIG. 4 is a plan view of the screwdriver with its parts in a position ready for driving a screw in a workpiece.

As shown in FIGS. 3 and 4, the bottom 7 of the outer guide frame 1 has a longitudinal cam slot 4 extending parallel to the screwdriver bit C and having an oblique end portion 5 located remotely from the attachment sleeve 2 and inclined substantially at an angle of 45 degrees to the longitudinal axis of the outer guide frame 1 or the screwdriver bit C. The oblique end portion 5 of the cam slot 4 terminates just short of a front end of the outer guide frame 1. The outer end of the cam slot 4 is located adjacent to an opposite or rear end portion of the outer guide frame 1. The slide plate 20 has a cam slot 24 defined in a rear end portion thereof which is remote from the nose 21, the slot 24 having a transverse portion 24*a* extending perpendicularly to the screwdriver bit C and slightly curved rearward. The slot 24 has one end 25 substantially aligned longitudinally with the closed end of the oblique cam slot portion 5 and the other end portion 26 directed forward toward the nose 21 and held substantially in longitudinal alignment with the cam slot 4. A pin 35 extend through the cam slots 4, 24 and holds the slide block 10 in the fully projected position (FIG. 3) against the combined force of the springs 33, 34 when the pin 35 is positioned at the ends of the oblique cam slot portion 5 and the transverse cam slot 24. Stated otherwise, the pin 35 as thus positioned in the cam slots 5, 24 prevents the slide block 10 and the slide plate 20 from moving further out of the outer guide plate 1, with the nose 22 spaced from the front end of the slide block 10.

A screw indexing lever 51 (FIGS. 3 and 4) is swingably disposed in the recess 13 in the slide block 10 and is attached substantially centrally thereof to the slide block 10 by a screw 51*a* threaded into a threaded hole 18 in the slide block 10 opening into the recess 13. The screw indexing lever 51 supports on a rear end thereof the pin 35, and is angularly movable about the screw 51*a* in response to movement of the pin 35 along the cam slots 4, 24. More specifically, when the slide block 10 moves out of the outer guide frame 1 toward the position illustrated in FIG. 3, the lever 51 is turned counterclockwise about the screw 51*a* until the pin 35 reaches the ends of the cam slots 5, 24, to thereby advance screws S on a strip F one at a time into a position in front of the screwdriver bit C, whereupon the screwdriver E is ready for driving the advanced screw S into a workpiece.

The screw indexing lever 51 has a distal tapered end 52 bifurcated into a bent portion 52*a* directed away from the slide plate 20 and supporting a screw advancing finger 55 pivotably attached thereto by a pin 56, and stopper 53 with which the screw advancing finger 55 is engageable. A tension spring 58 acts between an upper end 54 of the screw advancing finger 55 and a pin 57 mounted on the slide block 10 to normally bias the screw advancing finger 55 in a directon to turn clockwise as shown in FIG. 6. The screw advancing finger 55 is normally held in a vertical position with the upper end 54 abutting sidewise against the stopper 53 under the resiliency of the tension spring 58. When the slide block 10 is retracted into the outer guide frame 1, the screw indexing lever 51 is turned clockwise (FIG. 4) about the screw 51*a* whereupon the screw advancing finger 55 moves leftward as shown in FIG. 6 until it engages a next screw S. The slide block 10 has an opening 19 (FIG. 7) adjacent to its front end in which the screw advancing finger 55 is movable back and forth for screw indexing operation.

The slide block 10 has at its front end portion a cut-away recess 49 in which there are mounted a pair of inner and outer guide plates 47, 48 for guiding therebetween the strip F of screws S, the guide plates 47, 48 having inner ends located in the slide block 10 adjacent to the bore 16 and outer ends disposed outside the slide block 10. The inner guide plate 47 has an opening 46 (FIGS. 6 and 7) held in communication with the opening 19 in the slide block 10 for permitting reciprocating movement therein of the screw advancing finger 55. The bore 16 opens at its distal end into the cut-away recess 49.

As shown in FIGS. 3 and 6, the screws S are mounted on the strip F at regular intervals, the strip F being made of synthetic resin. The screws S are made of a material which is hard enough to penetrate a relatively thin sheet of iron. The guide plates 47, 48 jointly define a channel 48*a* receptive therein of the heads of the screws S as the latter are fed along between the guide plates 47, 48. A leaf spring 50 is attached to the outer guide plate 48 for engagement at a distal end thereof with the screws S one at a time as the screws S are supplied, preventing the strip F from moving backward. The outer guide plate 48 is removably mounted on the slide block 10 by a screw 42 having an enlarged grip head 43. Thus, the screws S on the strip F can readily be removed upon detachment of the outer guide plate 48.

The power-driven screwdriver E thus constructed will operate as follows: The strip F on which the screws S are mounted is first inserted between the guide plates 47, 48 until a first screw S is located below the bore 16 in alignment therewith. With the protective plate 22 held flatwise against a workpiece M to be fastened to a sheet L of iron, the motor-driven tool A is then pushed toward the workpiece M, whereupon the slide block 10 and the slide plate 20 are caused by the pin 35 to move together into the outer guide frame 1 (upwardly as shown in FIGS. 4 and 5) against the resiliency of the spring 34 as the pin 35 slides in the oblique cam slot portion 5 and the transverse cam slot 24, enabling the screw indexing lever 51 to turn clockwise about the screw 51*a*. When the pin 35 enters the longitudinal cam slot 4 and the cam slot portion 26, the slide plate 20 is allowed to slide slightly upwardly into the slide block 10 against the force from the spring 33. Such upward movement of the slide plate 20 causes a portion of the protective plate 22 to abut against and hold a next screw S stably between the guide plates 47, 48, as shown in FIG. 4, while the first screw S is being driven into the workpiece M and the iron sheet L.

At the same time, the screw advancing finger 55 moves leftward from the position illustrated in FIG. 6 against the bias of the spring 58 as the finger 55 is turned counterclockwise about the pin 56 until the finger 55 moves past the next screw S. When the clockwise angular movement of the screw indexing lever 51 is completed as shown in FIG. 4, the screw advancing finger 52 has traversed the next screw S and is forced to turn clockwise about the pin 56 under the bias of the spring 58.

Continued movement of the motor-driven tool A toward the workpiece M causes the slide block 10 to slide deeply into the outer guide frame 1, while at the same time permittng the pin 35 to move upwardly in and along the longitudinal cam slot 4. The screw-indexing lever 51 thus remains tilted in the position shown in FIG. 4. The distal end of the screwdriver bit C is now brought into contact wih the head of the screw S located in alignment with the bore 16. When the motor-driven tool A is pushed on, the screwdriver bit C forces the tip of the screw S to pass through a bushing or sleeve 27 on the protective plate 22 and to be held against the workpiece M. The bushing 27 serves to prevent the screw S from being skewed or inclined while the screw S is being advanced toward the workpiece M. Then, the motor-driven tool A is energized to rotate the screwdriver bit C, thus causing the screw S to rip off the strip F and driving the same home into the workpiece M and the iron sheet L, whereupon the latter is tapped by the screw S. Thus, the workpiece M and the iron sheet L are firmly fastened together by the screw S, as illustrated in FIG. 5.

The outer guide frame 1 has a slant slot 6 having one end positioned adjacent to the longitudinal cam slot 4. A stop pin 36 extends through the slant slot 6 and is slidable along but fastenable at desired positions in the slot 6. When a rear end of the slide block 10 abuts against the stop pin 36 as fixed in the slot 6, the slide block 10 is no longer permitted to slide into the outer guide frame 1. Thus, the stop pin 36 serves as an adjustment pin for adjusting the extent to which the slide block 10 is insertable back into the outer guide frame 1 and hence the extent to which the screw S is driven into the workpiece M.

After the first screw S has been driven, the power-driven tool A is retracted away from the workpiece M. The slide block 10 and the slide plate 20 are now released. The slide plate 20 is forced to move relatively to the slide block 10 uner the bias of the spring 33, allowing the protective plate 22 to disengage the next screw S, as the slide block 10 and the slide plate 20 slide in a direction out of the outer guide frame 1 under the force of the spring 34. When the pin 35 enters from the longitudinal cam slot 4 into the oblique cam slot portion 5 and from the cam slot portion 26 into the transverse cam slot portion 24*a*, the screw indexing lever 51 starts swinging counterclockwise about the screw 51*a* whereupon the screw advancing finger 55 engages and indexes the next screw S to the position below the bore 16 in alignment therewith.

As shown in FIG. 2, the slide block 10 has a presser pin 37 which is spring-biased to hold the head of the supplied screw S against a wall of the bore 16, thereby preventing the screw S from getting skewed in the bore 16.

The strip F is preferably composed of two molded layers of thermoplastic synthetic resin, one being thinner than the other, sandwiching the screws S therebetween. When the screw S is rotated by the screwdriver bit C, only the thinner layer is ruptured to free the screw S. Thus, the strip F is prevented from being torn to bits when the screws S are separated therefrom. Two of such strips F may be employed to support screws S which are relatively long. The strip F from which screws S have been removed is successively discharged out of the power-driven screwdriver E.

Figure 9:
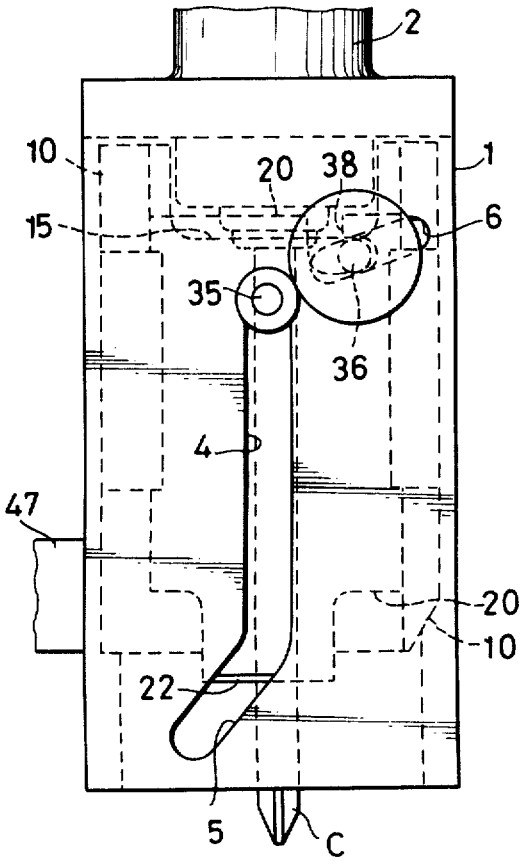
FIG. 9 is a plan view of an outer guide frame with the slide block of FIG. 7 shown as being in a fully retracted position therein.

Repeated use of the power-driver screwdriver E tends to wear the front end of the screwdriver bit C at a rapid rate. The screwdriver bit C as worn to the point where it can no longer be used can be replaced as follows: The pin 36 is positioned at the end of the slot 6 which is located adjacent to the longitudinal cam slot 4, and then the slide block 10 is inserted fully into the outer guide frame 1 against the force of the spring 34. The pin 36 is inserted into a hook-shaped slot 38 defined adjacent to the cavity 15 in the slide block 10 and is retained therein by being displaced in a direction away from the longitudinal slot 4. The slide block 10 is now held in the fully inserted position in the outer guide frame 1, with the end of the screwdriver bit C projecting out of the outer guide frame as illustrated in FIG. 9. The screwdriver bit C is pulled out by pliers or other tools, and a new screwdriver bit is inserted into the bore 16 and attached to the rotatable member B of the motor-driven tool A.

Although a certain preferred embodiment has been shown and described in detail it should be understood that various changes and modifications may be made therein without departing from the scope of the appended claims.

What is claimed is:

1. A power-driven screwdriver for attachment to a motor-driven tool for being driven thereby, comprising:

(a) an outer guide frame adaped to be mounted on the motor-driven tool;

(b) a slide block slidable into and out of said outer guide frame and having a bore;

(c) a screwdriver bit extending through said bore and adapted for attachment to the motor-driven tool, said outer guide plate having a first cam slot substantially parallel to said screwdriver bit and including an oblique portion;

(d) a slide plate slidably mounted on said slide block and having a protective plate, said slide plate having a second cam slot substantially normal to said screwdriver bit;

(e) a spring disposed around said screwdriver bit and acting between said outer guide frame and said slide block to normally urge the latter in a direction to slide out of said outer guide frame to a position in which a distal end of said screwdrier is disposed in said slide block, said slide block and slide plate being movable into said outer guide frame against the bias of said spring when the motor-driven tool is pushed toward a workpiece with said protective plate held against the workpiece, before said screwdriver bit drives a screw home into the workpiece; and (f) a screw indexing lever swingably mounted on said slide block and having a pin received in said first and second cam slots, said screw indexing lever being angularly movable to supply a next screw to a position in front of said screwdriver bit in response to movement of said pin in and along said oblique portion of aid first cam slot and said second cam slot.

2. A power-driven screwdriver according to claim 1, in which said oblique portion of said first cam slot and said second cam slot are substantially coextensive with each other in a direction normal to said screwdriver bit.

3. A power-driven screwdriver according to claim 1, said outer guide frame having a slant slot inclined with respect to said first cam slot, including a stop pin fastenably disposed in said slant slot, said slide block being engageable at a rear end thereof with said stop pin when said slide block is inserted into said outer guide frame, said stop pin being positionally adjustable in said slant slot to adjust the extent to which said slide block is insertable into said outer guide frame and the extent to which the screw can be driven into the workpiece.

4. A power-driven screwdriver according to claim 3, in which said slide block has a hook-shaped slot adjacent to the rear end thereof for receiving and retaining said stop pin when said slide block and said slide plate are fully inserted into said outer guide frame, with a distal end of said screwdriver bit projecting out of said outer guide frame.

5. A power-driven screwdriver according to claim 1, including a presser pin mounted on said slide block and spring-biased to hold the screw in said bore.

6. A power-driven screwdriver according to claim 1, in which said protective plate supports a bushing for passage therethrough of the screw while the latter is being driven by said screwdriver bit.

7. A power-driven screwdriver according to claim 1, said screw indexing lever supporting a screw advancing finger pivotably mounted thereon for engaging and feeding screws one at a time to said position in front of said screwdriver bit, there being a spring acting between said screw advancing finger and said slide block for normally urging said screw advancing finger into driving engagement with a screw.

* * * * *